United States Patent [19]

Brandon

[11] 4,162,847

[45] Jul. 31, 1979

[54] HOT ROLL FUSER EARLY CLOSURE INHIBITOR

[75] Inventor: Fred Y. Brandon, Boulder, Colo.

[73] Assignee: International Business Machines Corporation, Armonk, N.Y.

[21] Appl. No.: 839,856

[22] Filed: Oct. 6, 1977

[51] Int. Cl.[2] ..... G03G 15/00; F27B 9/28

[52] U.S. Cl. ..... 355/14; 219/216; 355/3 FU; 432/60

[58] Field of Search ..... 355/1, 3 R, 3 FU, 14; 219/216; 432/60, 228

[56] References Cited

U.S. PATENT DOCUMENTS

| | | | |
|---|---|---|---|
| 3,357,249 | 12/1967 | Bernous et al. | 355/3 FU X |
| 3,754,819 | 8/1973 | Braun | 355/3 FU |
| 3,794,417 | 2/1974 | Machmer | 355/3 FU |
| 3,809,475 | 5/1974 | Post et al. | 355/3 FU |
| 3,851,144 | 11/1974 | Hutner | 219/216 |

OTHER PUBLICATIONS

Ernst et al; "Heater Control Circuit", IBM Technical Disclosure Bulletin, Oct., 1972, vol. 15, No. 5, p. 1587.

Gaitten et al, "Pressure Roll Support", IBM Technical Disclosure Bulletin, May 1973, vol. 15, No. 12, p. 3644.

Brandon et al, "Dry Hot Roll Fuser Having Early Fusing Nip Closure", Jun. 1, 1976.

*Primary Examiner*—Fred L. Braun

*Attorney, Agent, or Firm*—Earl C. Hancock

[57] ABSTRACT

A heated fuser roller and backup roller fix toner on a sheet passing therebetween. These rollers are separated during nontoner fixing periods and normally closed for a predetermined early closure period prior to arrival of a sheet at the nip between the rollers. The immediate past history of fusing activity is monitored to determine whether the early roll closure is to be inhibited, a situation existing whenever the immediate past history indicates that steps must be taken to prevent backup roller overheating. The past history monitoring is performed by direct backup roller temperature sensing, timeout circuit operation or the like.

5 Claims, 6 Drawing Figures

HOT ROLL FUSER EARLY CLOSURE INHIBITOR

BACKGROUND OF THE INVENTION

1. Field of the Invention

The present invention relates to hot roll fuser operations and procedures in a toner fixing station associated with xerography, electrophotography or the like. More particularly, the present invention relates to xerographic types of processing wherein a hot roll fuser and a backup roller are moved into and out of circumferential engagement at various stages associated with the fixing of toner particles on a copy sheet passing between such rollers. The present invention is particularly useful in xerographic copying apparatus using dry release hot roll contact fusers with backup rollers which are utilized to aid in the control of the hot roll temperature.

2. Description of the Prior Art

In xerographic processing, an image is transferred to a copy medium such as copy paper by means of a toner which is usually a pigmented thermoplastic resin. These toner particles are not firmly attached to the copy medium until they have been softened under heat. This softening requires heating of the toner to a relatively high temperature, usually in excess of 200° F. One method of so heating the toner is by hot roll contact fusing. The hot roll fuser operates to pass the toned copy sheet through a fusing nip formed by a heated and driven fuser roller and a movable backup roll. As a result of this contact fusing, the softened toner causes the toned side of the copy paper to tend to ahere to the surface of the hot roll. Thus the copy paper sheet tends to follow the hot roll instead of continuing on the intended paper path subsequent to the fuser station.

A prior art solution to this paper sticking problem is to employ a thick deformable elastomer coating on the hot roll while the backup roll is provided with a rigid surface. Consequently the closing of the fusing nip results in a footprint deformation into the thick, soft coating of the hot fuser roll. An advantage of such a structure is that the nip configuration of the deformable hot roll provides a contour shaped so as to aid in release of the toned side of the paper from the hot roll. The shape of this nip is such that the paper is literally pushed away from the hot roll upon exit from the nip thereby tending to overcome the tendency of the hot toned sheet to stick to the surface of the hot roll.

With such fuser configurations, it is necessary that the hot roll metal core be maintained at a temperature higher than the optimum fusing temperature. This is true since a copy run involving a number of sheets requires that sufficient heat be supplied through this relatively thick heat insulator coating to prevent the fusing nip temperature from dropping to a temperature below the optimum fusing level. However, the use of the thick elastomer coating on the hot roll allows the hot roll fusing surface to achieve unduly high temperatures, substantially above the optimum fusing temperature, when in a standby condition. That is, during idle periods when fusing is not being performed, the thick elastomer coating which is a good heat insulator will approach the temperature of the hot roll metallic core although the two temperatures never reach parity as a practical matter.

In defensive publication T947,012, entitled "Dry Hot Roll Fuser Having Early Fusing Nip Closure" by F. Y. Brandon and J. F. Zimmer, published June 1, 1976 (947 OG 15), apparatus is shown for successfully overcoming the problems in a dry release hot roll fuser where the hot roll is coated with a thick deformable elastomer or the like by providing early closure between the hot roll fuser and the backup roll. Thus, even though the external surfaace of the elastomer coating reaches an unduly high temperature during a standby period, the early closure of the fusing nip causes this external surface to be cooled much as it would be cooled by the fusing of copy sheets. By the time the first sheet to be fused arrives at the fusing nip, the temperature at the fusing nip has lowered to the vicinity of the optimum fusing temperature and adequate fusing occurs without release failure. This is effective since the rigid backup roll is constructed and arranged so as to have characteristics which more or less simulate the cooling effect of a sheet to be fused.

Although the hot roll adherence problem is resolved by the aforementioned prior art apparatus, paper feed failures still may occur particularly if the backup roll temperature reaches an elevated level such as in excess of 200° F. For reasons mentioned in T947,012, early roll closure on the first copy of a set is a desirable fuser property. However, whenever certain usage of the copier is encountered, such as sequential runs of one copy each, the hot roll and the backup roll will be in closure for extended periods causing the backup roll to overheat. This results eventually in the copy sheet tending to follow the backup roll instead of proceeding on its intended paper path thereby creating a jam. The backup roll sticking problem is especially aggravated when the second side of a duplexed copy sheet is being fused.

SUMMARY OF THE INVENTION

With the present invention, it is possible to realize both the advantages of the early roll closure processing as described in T947,012 while avoiding the problems of copy sheet adherence to an overheated backup roll. That is, the present invention is useful in a copier system which has a heated fuser roller and a backup roller with these rollers being mounted for closure movement therebetween. Such a system includes controls for causing the roller closure to occur for a predetermined period prior to arrival of a sheet at the nip of the rollers (the early closure concept) and for a period of time thereafter especially to accommodate complete heat processing of the copy sheet. The improvement of the present invention includes monitoring of the past history of the closure of the rollers so as to provide an output indicative of the backup roll temperatures in excess of a predetermined level. This predetermined level corresponds to a temperature level below the temperature at which the copy sheet will begin evidencing tendencies to adhere to the backup roll. This past history monitoring is used to inhibit the early closure for a predetermined period whereby the fuser roller and the backup roller are not brought into circumferential engagement until the copy sheet is ready to be fed to the fuser nip.

The immediate past history monitoring can be effected in several ways. For instance, the backup roll temperature can be directly sensed through a thermistor or thermocouple which is connected via a threshold circuit to provide an appropriate signal to the closure controls so as to inhibit the early roll closure when the backup roll temperature exceeds the critical predetermined level. The immediate past copying history can likewise be monitored through timeout circuits which indicate whether the heated fuser roller and backup roller have been separated for an adequate period of time to prevent the backup roller temperature from rising beyond an acceptable level so that early roll closure can be allowed.

The foregoing and other objects, features, advantages and applications of the present invention will be readily apparent to those having normal skill in the art from the following more particular description of the exemplary preferred embodiments of this invention as illustrated in the accompanying drawings.

DETAILED DESCRIPTION OF THE PREFERRED EMBODIMENTS

Figure 1:
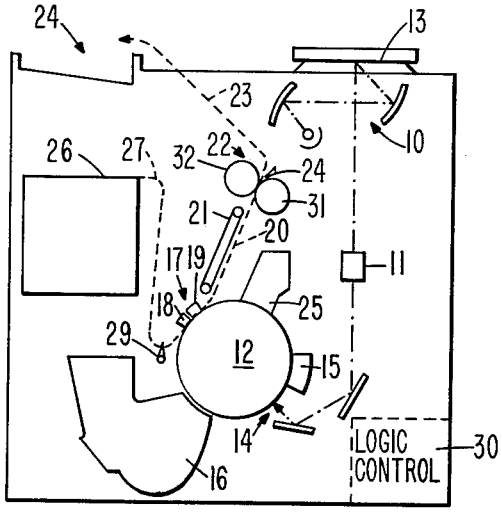
FIG. 1 is a schematic view of a xerographic copying apparatus incorporating the present invention.

FIG. 1 is a somewhat schematic view of a typical xerographic copying apparatus in which the present invention can be implemented. As is known, the surface of photoconductor drum 12 is charged by corona 15 and receives the latent image of original document 13 at imaging station 14 via the scanning mirror system 10 and a moving lens 11. Subsequently the latent image is developed by developer 16.

Copy sheets from supply 26 are transferred over a paper path 27 to gate 29 where they are introduced to drum 12 in synchronism with the latent image on the surface of drum 12. The toned image on the surface of drum 12 is transferred to the copy paper at transfer station 17 by operation of transfer corona 18. Sheet detach means 19 causes the toned sheet to leave the surface of drum 12 and follow path 20 via vacuum conveyor 21 to the dry release hot roll fuser assembly 22. After fusing, the finished copy sheet follows path 23 to output tray 24. The surface of drum 12 is cleaned by cleaning station 25 preparatory for the next copy cycle. Control logic 30 is operable to program or time the operation of the various mechanisms within the copying apparatus of FIG. 1.

As discussed in T947,012, early closure of the dry release hot roll fuser can prevent the toned side of the copy sheet from adhering to hot roll 31 as the sheet is pressed into the hot roll 31 by backup roll 32. The fusing nip formed by rolls 31 and 32 is opened and closed by control logic 30 in response to a drum position sensing means (not shown) which responds to the position of drum 12 and effects opening and closing of the nip by means of a control system, not shown in FIG. 1. An exemplary mechanism for effecting the opening and closing of the nip between rollers 31 and 32 is shown in the IBM TECHNICAL DISCLOSURE BULLETIN of May 1973 at page 3644 (Vol. 15, No. 12) in the article entitled "Pressure Roll Support" by Gaitten et al.

With the exception of the early closing described in T947,012, it is desirable that the fusing nip be closed only when paper is between the rolls. Thus it is desirable to open the fusing nip during the intersheet gap which may exist between adjacent sheets to be fused and to close the nip when the next sheet arrives. Alternatively, the sheet velocity may be reduced in the fuser to eliminate the intersheet gap such as is shown in U.S. Pat. No. 3,794,417 by Machmer.

Figure 2:
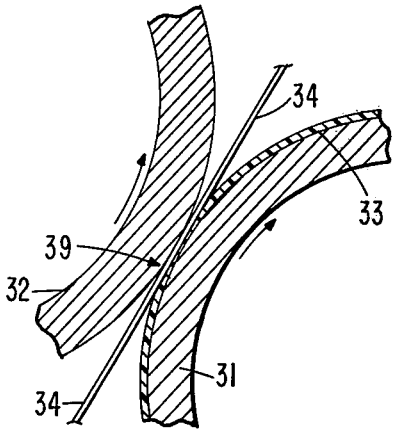
FIG. 2 is a broken and sectioned side view of the rollers employed for the fusing nip in FIG. 1.

FIG. 2 discloses some of the detail of the hot roll fuser assembly 22 in FIG. 1. Hot roll 31 might typically be an aluminum cylinder having a thick deformable silicon elastomer outer layer 33. Insulating end walls are fitted into cylinder 31 at each end and support bearings associated therewith support the cylinder for rotation about its longitudinal axis. A conventional tungsten filament infrared heater element is located along this axis. A reflective end plate may be carried within the cylinder at each end to improve the axial uniformity of heat reception by the cylinder from the lamp. The inner surface of cylinder 31 may be darkened to improve its radiant energy absorption characteristics.

Backup roll 32 is constructed and arranged to simulate the cooling effect of the sheets to be fused. Specifically, roll 32 may be a polished chromium plated steel roll or it may be made of a tubular aluminum extrusion having a relatively heavy cylindrical wall section and, for example, a smooth outer surface coated with polytetrafluoroethelene. As is illustrated in FIG. 2, the deformable outer layer 33 of heated fuser roll 31 is indented by backup roll 32 to produce at the exit of the fusing nip 39 a curvature tending to separate paper copy sheet 34 from the surface of the heated roll 31. The thick, deformable outer surface 33 of hot roll 31 is typically an elastomeric heat insulating layer. An example of such a material is a silicon elastomer such as the silicon rubber material manufactured and sold by General Electric Corporation and designated as RTV-60. A preferred dry release hot roll fuser is described in U.S. Pat. No. 3,848,305 by Jachimiak.

The metal tube or core of hot roll 31 is maintained at a controlled temperature by a temperature sensing and control means, not shown. An exemplary means for accomplishing this is described in the IBM TECHNICAL DISCLOSURE BULLETIN of October 1972 at page 1587 (Vol. 15, No. 5) in the article entitled "Heater Control Circuit" by Ernst and Neal. A temperature sensor, also not shown, operates to sense the temperature of the outer surface of the metal tube for roller 31. Since layer 33 is a heat insulator, the temperature of this outer surface is maintained above the optimum fusing temperature during standby periods when the fusing nip 39 is open.

Figure 3:
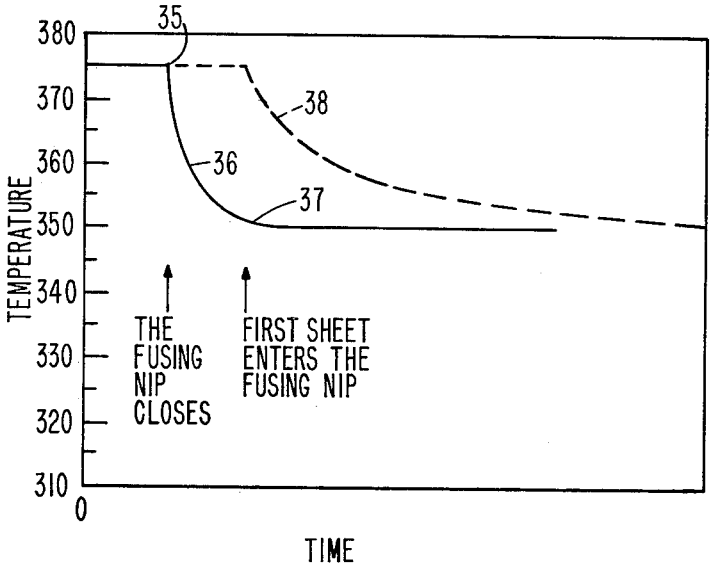
FIG. 3 is a time-temperature graph for the fusing nip temperature profile achieved both with and without early roll closure.

With reference to FIG. 3, an exemplary control temperature for the outer surface of layer 33 is seen to be about 375° F. during standby periods. At time 0, control logic 30 of FIG. 1 is enabled to begin a copy run. The temperature profile of the surface of fuser roll 31 as plotted in FIG. 3 assumes a previous standby period of sufficient length for the outer surface of layer 33 to have attained a stable temperature, namely 375° F. As the copy process continues, control logic 30 operates to close the fusing nip 39. This is indicated as point 35 on the curve. From this time, the hot roll 31 and backup roll 32 are in peripheral engagement for at least one complete revolution with no sheet interposed between them. As a result of the cooling effect provided by backup roll 32, the fusing temperature drops rapidly following curve 36. At 37, the first sheet arrives to be fused and the temperature of the fusing nip 39 has now been cooled approximately to the optimum fusing temperature, namely about 345° F. to 355° F.

Backup roll 32 has a cooling effect somewhat greater than the sheets to be fused. That is, backup roll 32 must cool the outer surface of layer 33 at least as well as sheets to be fused. For comparison, dotted line 38 plots the fusing temperature of a hot roll having a thick deformable elastomeric heat insulating coating when early closure of the fusing nip is not provided. In this case, the first sheet is subjected to an average initial fusing temperature of about 370° F. and sticking to hot roll 31 is likely to occur.

In a typical implementation, hot roll 31 and backup roll 32 may be constructed with diameters of between 1 to 5 inches; the deformable elastomeric heat insulating coating 33 on hot roll 31 may have a thickness in the range of from 0.02 to 0.06 inches; and the surface velocity of the rolls is such as to achieve a sheet velocity through the fusing nip 39 of from 10 to 30 inches per second. The fusing nip 39 preferably has a width in the range of from 0.1 to 0.4 inches measured in the direction of roll rotation.

Figure 4:
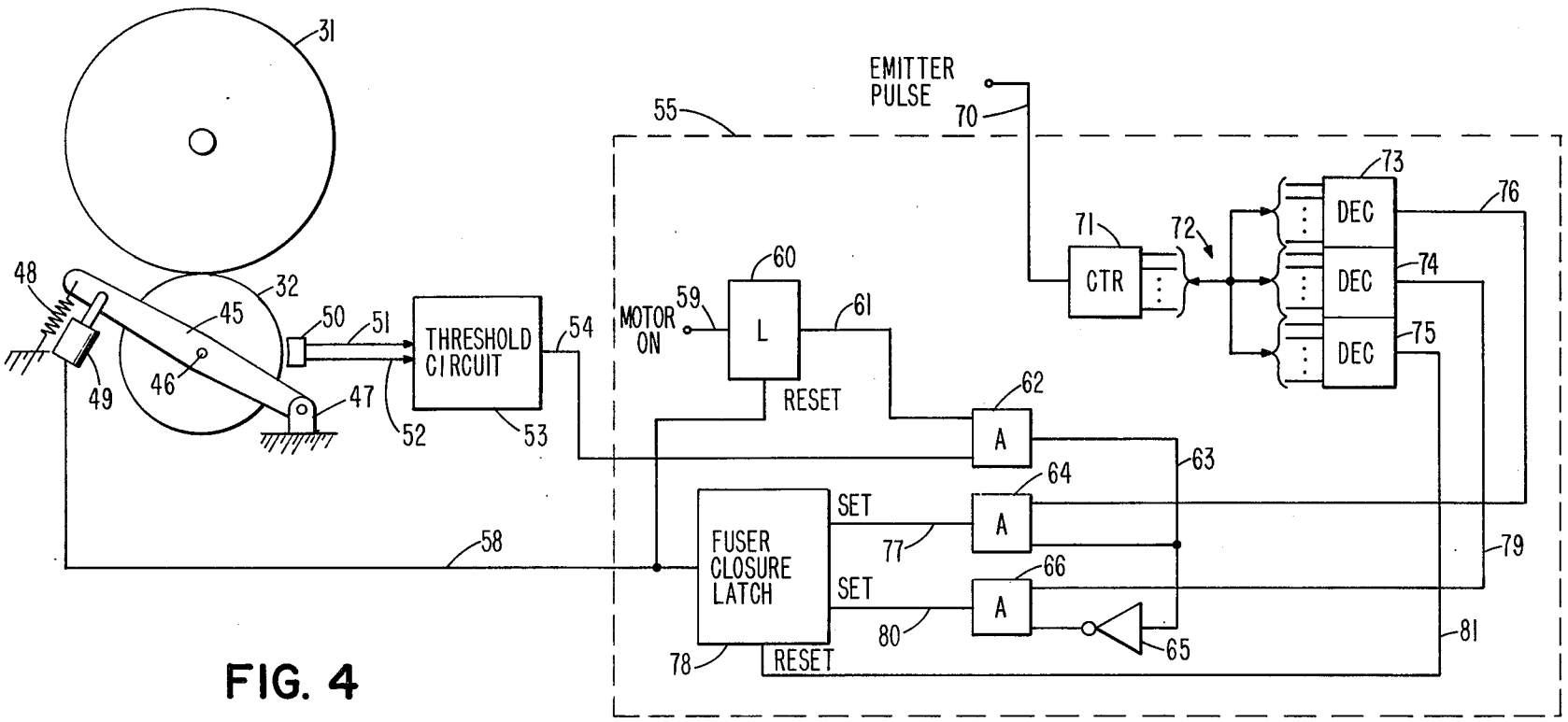
FIG. 4 is a partially schematic diagram of the direct backup roll temperature sensing embodiment of the present invention.

FIG. 4 illustrates an arrangement in accordance with the present invention for monitoring the immediate copy run past history by means of direct backup roll temperature sensing. The backup roll 32 is shown rotatably mounted to cross arm 45 by spindle 46. Arm 45 is pivotably mounted to the machine frame at 47 and is normally biased by spring 48 so as to open the nip between rolls 31 and 32. Actuation of solenoid 49 moves arm 45 and thus backup roll 32 into the closure position.

In the FIG. 4 embodiment, a temperature sensitive device 50 such as a thermistor or the like is shown mounted in close proximity to backup roll 32. Sensor 50 is mounted so as to maintain a constant position relative to backup roll 32 by means not shown regardless of the pivoting of roll 32. Sensor 50 can likewise be mounted internally to roll 32 or fixed to the inner, outer or end surfaces of roll 32 with appropriate readout connections such as through slip rings or the like.

The output from sensor 50 is connected via lines 51 and 52 to a threshold circuit 53. Circuit 53 converts the temperature information from sensor 50 into a binary logic signal. That is, as long as the temperature of backup roll 32 is below a predetermined acceptable level such as 200° F., an output of a first electrical level is produced from circuit 53. Once the temperature of backup roll 32 equals or exceeds the preselected maximum acceptable level, a second electrical output signal level is produced on line 54 to the copier system logic 55. Copier system logic 55 normally energizes solenoid 49 via output 58 for a predetermined early closure time when a copy cycle is started as has been described previously. However, the presence of the second output signal level from threshold circuit 53 at line 54 indicates to the copier system logic 55 that the backup roll temperature 32 is excessive and closure is not to be effected until the copy sheet has arrived or is about to arrive at the fuser nip. Accordingly, copier system logic 55 delays the actuation of line 58 and thus solenoid 49 until the copy sheet is in the vicinity of the fuser nip.

The copier system logic 55 is arranged to render several decisions in the copier cycle in addition to its normal control functions. Thus, after a copy cycle start signal has been introduced to logic 55, this logic will determine whether or not a new copy run has just begun. If not, the system will continue as before although the fuser roll nip can be opened for intervening periods between document arrivals at the nip if desired. Conversely, if a new copy run has begun, the logic must then determine whether the preceeding copy cycle past history is adequate so that the temperature of roll 32 is acceptable. This can be done by sampling the output of sensor 50 or its equivalent. An alternative is to determine whether a predetermined time period has elapsed since the end of the previous copy run since the temperature stabilization of the roll 32 during idle time when the nip is open can be presumed to have permitted temperature stabilization to an acceptable level for roll 32. An example of a timing controlled system for copy cycle past history monitoring will be described later herein in conjunction with FIG. 5. If the sensor output 50 is acceptable or the predetermined timeout period has passed, logic 55 allows the closure of the fuser rolls 31 and 32 early enough so that the backup roll 32 absorbs heat from the hot roll 31 and thus reduces the hot roll temperature to an acceptable level as described previously for FIG. 3.

Conversely, if the temperature level from sensor 50 is not acceptable or the predetermined time out period has not passed, logic 55 closes the fuser rolls 31 and 32 at the proper time for normal fusing without early roll closure. It can be reasonably assumed that the temperature of hot roll 31 is near an acceptable level due to the relatively short time period since the last copy sheet was fused.

The circuit elements of the copier system logic 55 associated with the early roll closure inhibit system are also shown in detail in FIG. 4. The start of a copy cycle is reflected by the presence of a MOTOR ON signal at input 59 setting latch circuit 60. The set output 61 of latch 60 partially conditions AND circuit 62. In turn, the output 63 of AND 62 provides a direct conditioning input to AND 64 while the inverted or NOT condition of 63 is coupled as an input to AND 66 via inverter circuit 65. Thus, as long as input 54 from threshhold circuit 53 does not indicate an excessive backup roll 32 temperature, AND 64 will be conditioned and AND 66 will not be conditioned.

Control logic 55 includes circuitry for producing a sequence of three timing pulses during each copy sheet fusing cycle. A source of regularly recurring pulses such as from an emitter associated with the photoconductor drum (not shown) are coupled to logic 55 through input 70. These pulses are employed to increment counter circuit 71 with the contents of counter 71 as reflected by output lines 72 being continuously inspected by decoders 73, 74 and 75.

Decoder 73 is arranged to produce an output signal on line 76 for an earlier count content in counter 71 than decoders 74 and 75. This output on line 76 corresponds to the early roll closure control signal. Accordingly, assuming that input 54 is indicating that an acceptable backup roll 32 temperature is present, AND 64 will be conditioned so as to produce a set signal on line 77 thereby setting fuser closure latch 78 and producing an enabling signal on line 58 for solenoid 49. However, the presence of a signal on input 54 indicative of an excessive backup roll 32 temperature will result in deconditioning of AND 64 and no effect on latch 78 in the presence of a signal on line 76. Under these conditions, the output 79 of decoder 74 which occurs subsequently to the output 76 will result in completion of the enabling of AND 66 and thus the production of a signal on line 80 setting fuser closure latch 78 immediately prior to or upon the arrival of the copy sheet at the nip between the closure and backup rolls. Thus, this late pulse on line 79 effects the early roll closure inhibiting.

Decoder 75 is set to detect the presence of a higher count content in counter 71 than either decoder 73 or 74. The output 81 from decoder 75 causes fuser closure latch 78 to be reset preparatory for continued or renewed copy cycle operations. Note that the set output 58 of latch 78 is likewise coupled to reset latch 60. Latch 60 is arranged to be set by only the leading edge of the MOTOR ON input 59 so that the latch 60 will remain reset after the output of latch 78 has been produced for continued cycling operations of the copier. Under these circumstances (i.e., after initiation of the first copy fusing cycle), the output of AND 62 will not be produced at line 63 during the remainder of each multiple cycle copying so that only AND 66 will be conditioned and the fuser closure latch 78 is set in response to the output of decoder 74 as reflected at line 79 to the exclusion of the early closure signal on line 76.

In a typical installation wherein paper is fed to the fuser nip at fourteen inches per second, decoder 73 output 76 occurs when the copy sheet leading edge is fourteen inches from the fuser nip while decoder 74 output 79 occurs with the leading edge three inches out. Additionally, decoders 73, 74 and/or 75 can be controlled by conventional means (not shown) so as to change the specific contents of counter 71 on which they produce their output. This might be desirable for synchronizing the operation of the circuitry shown with the copier control circuitry employed in its normal operation or for accommodating different paper lengths or the like. For example, in a copier wherein the copy cycles are synchronized with the leading edge of the copy sheet, it may be advantageous to decrease or increase the count sensitivity of decoder 75 in proportion to the paper length in process. Conversely, in copier machines wherein synchronization is effected on the trailing edge of the copy sheet, the count sensitivities of decoders 73 and 74 can be shifted to accommodate different paper lengths.

Figure 5:
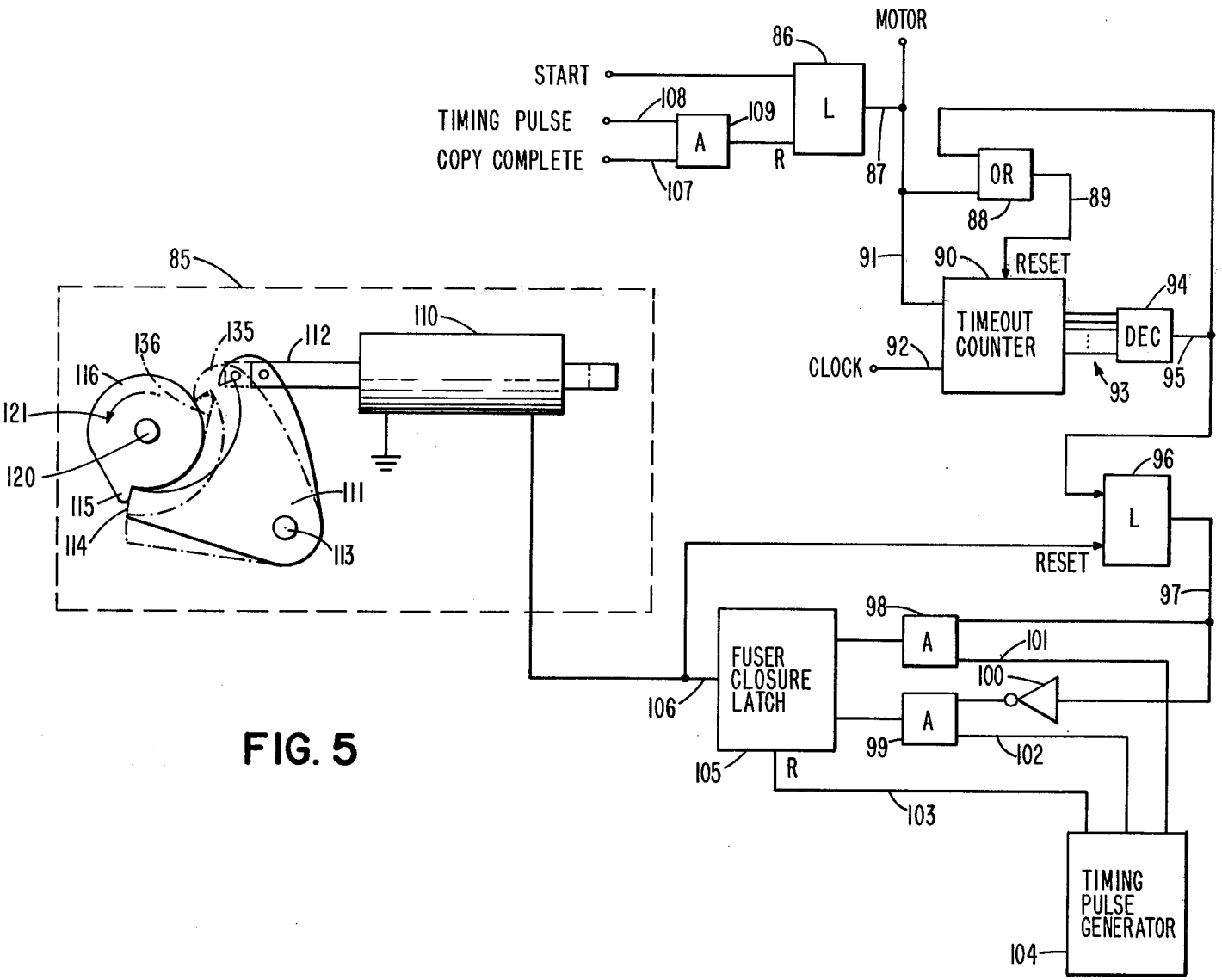
FIG. 5 is a partially schematic diagram of the controls associated with a timeout implementation of the present invention and additionally illustrating one form of roll closure control mechanism.

FIG. 5 depicts circuitry for controlling the roll closure without directly sensing the temperature of the rolls and additionally includes an illustration of one form of a roll closure controlling mechanism 85. The system operation is initiated by the START input signal setting latch 86 with its set output 87 being employed to energize the copier motor. Latch output 87 is also connected to OR circuit 88 with its output 89 resetting timeout counter 90. As long as the output 87 of latch 86 is down (i.e., the motor energization signal is absent), timeout counter 90 is conditioned to count clock pulses such as from an oscillator or the like at input 92. The clock pulses 92 increment timeout counter 90 when enabled by the absence of a motor energization signal on input 91 and the contents of counter 90 as reflected at output 93 is continuously inspected by decoder 94. As soon as a preselected count is stored in counter 90, decoder 94 produces an output signal on line 95 which resets counter 90 via OR 88 and reset line 89. In addition, output 95 sets latch 96. In an application wherein the copy sheets are fed at 14 inches per second and the temperature ranges for the fuser roll and backup roll are as described earlier herein, decoder 94 typically would be set for a ten second interval.

The set output 97 of latch 96 partially enables AND 98 whereas the absence of a set output 97 results in partial conditioning of AND 99 because of the presence of inverter circuit 100. The other conditioning input for AND 98 introduced to terminal 101 is an early closure timing pulse while the input 102 for completing the conditioning of AND 99 is a late timing pulse. Note that timing pulse generator 104 produces early timing pulse 101, late timing pulse 102 and the clear pulse 103 by circuitry similar to counter 71 and decoders 73, 74 and 75 as described previously for FIG. 4 or by any suitable timing control apparatus.

Accordingly, the output of either AND 98 or AND 99 sets fuser closure latch 105 whereas the subsequent occurrence of a clear pulse 103 resets latch 105. The output 106 from latch 105 resets or clears latch 96 and likewise enables the solenoid 110 of the roll closure control mechanism 85.

As long as latch 86 has not been cleared, timeout counter 90 will not be permitted to store incremental counts from clock pulses 92. Therefore, during repetitive cycle copying following the initiation of the first copy fusing, latch 96 is not set and only the late occurring pulses at 102 and the output of AND 99 are employed to set fuser closure latch 105. Eventually the copy cycle is completed as reflected by a signal at line 107 and in conjunction with a concurrently or subsequently occurring timing pulse 108, AND 109 is conditioned to produce a reset (R) input for latch 86. At this time, counter 90 is again enabled to accept incrementing pulses from clock 92 thereby permitting the subsequent setting of latch 96 if an adequate time interval has past since the end of the previous copying cycle to ensure that the backup roll 32 temperature is at an acceptable level below the temperature where the copy sheet may begin to follow the backup roll 32.

Figure 6:
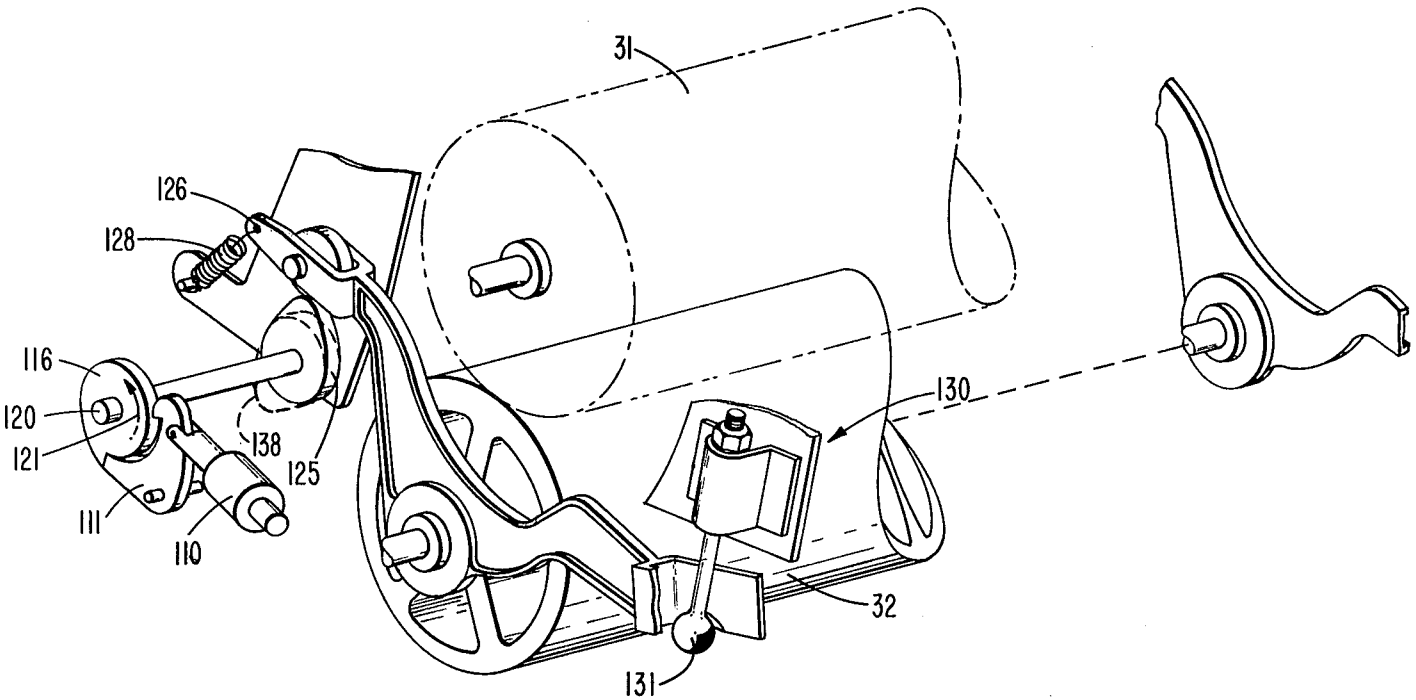
FIG. 6 is a perspective view showing the detail of a roll closure mechanism.

FIG. 5 also illustrates detail of a closure roll control mechanism 85 with an exemplary implementation of this mechanism being shown in FIG. 6. As shown, the presence of an enabling signal on line 106 from latch 105 energizes solenoid 110 so that the pawl 111 is retracted into the position shown in solid lines in FIG. 5. That is, actuation of solenoid 110 results in plunger 112 being retracted to the position shown in solid lines in FIG. 5 so as to pivot pawl 111 around shaft 113 so that the face 114 engages nub 115 on disk 116. Disk 116 is rotatably mounted on shaft 120 which is normally urged by a rotary torque force as illustrated by arrow 121 in FIGS. 5 and 6. With disk 116 held against pawl face 114 in the position shown in solid lines in FIGS. 5 and 6, cam 125 assumes the position shown in solid lines in FIG. 6 urging crossarm 126 upwardly so as to close the nip between backup roll 32 and fuser roll 31. As shown in FIG. 6, crossarm 126 is normally biased by spring 128 in the roll opening direction. The opposite end of arm 126 is attached to the machine frame via a resilient or yieldable mounting arrangement 130 and ball joint connection 131.

When solenoid 110 is deenergized, pawl 111 assumes the position shown in dotted or phantom lines at 135 in FIG. 5 so as to allow disk 116 to partially rotate around shaft 120 and assume the position shown at 136. This allows cam 125 to pivot to the position shown in dotted lines at 138 in FIG. 6 so that spring 128 is effective to separate rolls 31 and 32.

Although the present invention has been described with particularity relative to the detailed description of the exemplary preferred embodiments, various changes, modifications, additions and/or applications other than those specifically mentioned herein will be understood by those having normal skill in the art without departing from the spirit of this invention.

What is claimed is:

1. In a copier system having a heated fuser roller and a backup roller with the rollers mounted for closure movement therebetween and with controls for causing roller closure for either a first or second predetermined time period prior to arrival of a sheet at the nip of the rollers where the first predetermined time period is longer than the second predetermined time period, the improvement comprising:

means responsive to the past history of the closure of the rollers for providing an output indicative that the backup roller temperature is approaching a level at which sheets tend to adhere to the backup roller, and means responsive to said past history responsive means output for inhibiting the system controls from causing the first predetermined time period roller closure.

2. A copier system improvement in accordance with claim 1 wherein said past history responsive means includes means sensing the temperature of the backup roll for producing an output signal indicative thereof, and said past history means output responsive means includes a threshold circuit coupled to said sensing means output signal for generating a signal to the closure controls whenever said sensing means output signal exceeds a predetermined level.

3. In a copier system employing a heated fuser roller having a resilient surface thereon and a backup roller having a relatively rigid surface with the rollers mounted for opening and closure movement therebetween and with controls including a source of first and second timing pulses occurring before arrival of a copy sheet at the nip of the rollers wherein the first timing pulse occurs prior in time to the second timing pulse and with first and second closure controllers responsive to the first and second timing pulses, respectively, for causing the rollers to close wherein the first closure controller is normally operative for the initial copy cycle and the second closure controller is normally operative for all subsequent copy cycles of a multiple copy run, the improvement comprising:

means responsive to the past history of the closure of the rollers for providing an output indicative that the backup roller temperature is in excess of a predetermined level, wherein said predetermined level is below a level at which copy sheets tend to adhere to the backup roller, and means responsive to said past history responsive means for inhibiting operation of the first closure controller whereby operation of only the second closure controller occurs until said past history responsive means output indicates the backup roller temperature is below said predetermined level.

4. A copier system improvement in accordance with claim 3 wherein said past history responsive means includes a sensor thermally coupled to the backup roller for producing an output signal corresponding to the temperature level of the backup roller, and said past history means output responsive means includes a threshold circuit coupled to said corresponding temperature level output signal for generating first and second output signal levels when said corresponding temperature level output signal is respectively below and above a predetermined level.

5. A copier system improvement in accordance with claim 4 wherein said past history means output responsive means includes logic circuitry responsive to said first and second output signal levels generated by said threshold circuit for respectively enabling and disabling operation of the first closure controller.

* * * * *